US012698586B2

(12) United States Patent
Tarpinian

(10) Patent No.: US 12,698,586 B2
(45) Date of Patent: Aug. 4, 2026

(54) APPARATUS FOR CATCHING CLOTHES AND METHOD RELATED THERETO

(71) Applicant: SmileyPAT, LLC, Branchburg, NJ (US)

(72) Inventor: Peter Arshag Tarpinian, Branchburg, NJ (US)

(73) Assignee: SmileyPAT, LLC, Branchburg, NJ (US)

( * ) Notice: Subject to any disclaimer, the term of this patent is extended or adjusted under 35 U.S.C. 154(b) by 0 days.

(21) Appl. No.: 19/351,959

(22) Filed: Oct. 7, 2025

(65) Prior Publication Data

US 2026/0098375 A1 Apr. 9, 2026

Related U.S. Application Data

(60) Provisional application No. 63/704,320, filed on Oct. 7, 2024.

(51) Int. Cl.

| | |
|---|---|
| ***D06F 95/00*** | (2006.01) |
| ***D06F 39/14*** | (2006.01) |
| ***D06F 58/20*** | (2006.01) |

(52) U.S. Cl.

CPC ..... *D06F 95/004* (2013.01); *D06F 39/14* (2013.01); *D06F 58/20* (2013.01)

(58) Field of Classification Search

CPC ..... D06F 95/004; D06F 39/14; D06F 58/20; D06F 95/002; D06F 39/12; D06F 95/006; D06F 37/10; D06F 57/08; D06F 57/04; D06F 57/12; B65D 85/18; B65D 11/28; B65D 37/00

See application file for complete search history.

(56) References Cited

U.S. PATENT DOCUMENTS

| | | | | |
|---|---|---|---|---|
| 2,038,993 A | | 4/1936 | Erlanger | |
| 2,904,897 A | * | 9/1959 | Whyte | D06F 95/004 68/210 |
| 4,091,548 A | * | 5/1978 | Daily | D06F 58/04 34/202 |
| 4,677,760 A | * | 7/1987 | St. Louis | D06F 58/04 34/103 |

(Continued)

FOREIGN PATENT DOCUMENTS

EP 2157232 A1 2/2010

*Primary Examiner* — Devin K Barnett
(74) *Attorney, Agent, or Firm* — Budzyn IP Law, LLC

(57) ABSTRACT

In a first aspect, the subject invention provides an apparatus for catching clothes which includes: a base support affixable to a front loading washing machine or dryer; a first arm mounted to the base support and affixable to the front loading washing machine or dryer; a second arm pivotably mounted to the base support to be pivotable thereabout, the second arm being affixable to a hinged door of the front loading washing machine or dryer; a net secured to the first and second arms so as to extend therebetween below the access opening with the second arm being in different angular positions about the base support. The second arm is movable with the hinged door to be spaced from the first arm in extending the net below the access opening thereby providing a collapsible catch area spanning the distance between the machine's open door and the access opening.

20 Claims, 22 Drawing Sheets

(56) References Cited

U.S. PATENT DOCUMENTS

| | | | | |
|---|---|---|---|---|
| 6,385,862 | B1 * | 5/2002 | Vande Haar | D06F 58/04 34/106 |
| 7,228,646 | B1 * | 6/2007 | Purcell | D06F 58/04 34/104 |
| 9,850,622 | B1 * | 12/2017 | Lavernia | D06F 95/002 |
| 10,787,764 | B1 | 9/2020 | Day | |
| 10,866,027 | B2 * | 12/2020 | Bucko | D06F 58/00 |
| 12,410,550 | B2 * | 9/2025 | Leibman | D06F 39/083 |
| 2003/0010736 | A1 * | 1/2003 | Hope | D06F 58/04 211/90.03 |
| 2007/0119071 | A1 * | 5/2007 | Ackermann | D06F 58/04 34/322 |
| 2008/0168675 | A1 * | 7/2008 | Garman | D06F 58/14 34/239 |
| 2015/0048081 | A1 * | 2/2015 | Youssef | D06F 95/002 220/4.01 |
| 2015/0203283 | A1 * | 7/2015 | Speckmann | B65D 85/18 220/4.01 |
| 2015/0354129 | A1 | 12/2015 | Schwartz et al. | |
| 2017/0188702 | A1 * | 7/2017 | Petrizzi | D06F 39/14 |
| 2018/0148884 | A1 * | 5/2018 | Ciulla, Jr. | D06F 95/00 |
| 2019/0112751 | A1 * | 4/2019 | Hoffman | D06F 58/04 |

* cited by examiner

APPARATUS FOR CATCHING CLOTHES AND METHOD RELATED THERETO

CROSS-REFERENCE TO RELATED APPLICATION

This application claims priority to U.S. Provisional Patent Appl. No. 63/704,320, filed Oct. 7, 2024, the entire contents of which are incorporated by reference herein.

BACKGROUND OF THE INVENTION

1. Field of the Invention

The subject invention relates to apparatuses, devices, arrangements, and methods to catch clothes inadvertently dropped from a washing machine or dryer, upon removal.

2. Description of the Prior Art

Apparatuses are known in the prior art for catching clothes which may have been inadvertently dropped when being removed from a washing machine or dryer. Front loading washing machines and dryers may provide no support surface, or the like, below the access opening of the machine. Clothes inadvertently dropped upon removal from a front loading washing machine or dryer generally fall straight to the ground. This is a particular nuisance when clothes have been washed and are clean and drop on a dirty floor.

This problem has been recognized in the prior art. U.S. Published Patent Appl. No. 2015/0048081 A1 to Youssef et al. discloses baskets which may be mounted to a front loading washing machine, below the access opening, to catch clothes inadvertently dropped upon removal. The baskets are fixed frame, with FIGS. 10 and 11 showing embodiments where the frame is swiveled to a non-use position.

U.S. Published Patent Appl. No. 2015/0203283 A1 to Speckman discloses a shelf mountable below the access opening of a front loading washing machine to catch clean dropped clothes.

SUMMARY OF THE INVENTION

In a first aspect, the subject invention herein provides an apparatus for catching clothes which inadvertently fall during removal from a front loading washing machine or dryer, the front loading washing machine or dryer having an access opening on a front face thereof with a hinged door being pivotable about a hinge axis to selectively cover and expose the access opening, the apparatus having: a base support affixable to the front face of the front loading washing machine or dryer; a first arm having first and second ends, the first end of the first arm being mounted to the base support, the first arm being affixable to the front face of the front loading washing machine or dryer; a second arm having first and second ends, the first end of the second arm being pivotably mounted to the base support so that the second arm is pivotable about the base support, the second end of the second arm being affixable to the hinged door at a location spaced from, and not coincident with, the hinge axis such that the second end of the second arm is movable with the hinged door; a net secured to the first and second arms so as to extend therebetween below the access opening with the second arm being in different angular positions about the base support. With the second end of the second arm affixed to the hinged door at a location spaced from the hinge axis and with the hinged door covering the access opening, the second end of the second arm is in proximity to the second end of the first arm. With the second end of the second arm affixed to the hinged door at a location spaced from the hinge axis and with the hinged door positioned to expose the access opening, the second end of the second arm is spaced from the second end of the first arm with the net extendings between the first and second arms below the access opening. Advantageously, the subject invention provides an apparatus for catching clothes inadvertently dropped from a front loading washing machine or dryer which is collapsible and which provides a catch area fully spanning the distance between the machine's open door and the access opening.

As used herein, "front loading" refers to a washing machine or dryer which has an access opening on a front face of the machine. This is in contrast to top loading machines where clothes are dropped into an access opening formed in a top side of the machine. As will be understood by those skilled in the art, the top side is normal to gravity with the front face being oriented 90 degrees from the top side. In addition, as used herein, "affix," "affixable," "affixed," and further derivatives thereof, refers to being held adjacent to, or on, a fixed location (e.g., adjacent to, or on, a front face of a front loading washing machine or dryer), whether being physically attached (e.g., by using fasteners (e.g., screws)) or removably attached (e.g., by using suction cups or magnets).

DETAILED DESCRIPTION

Figure 1:
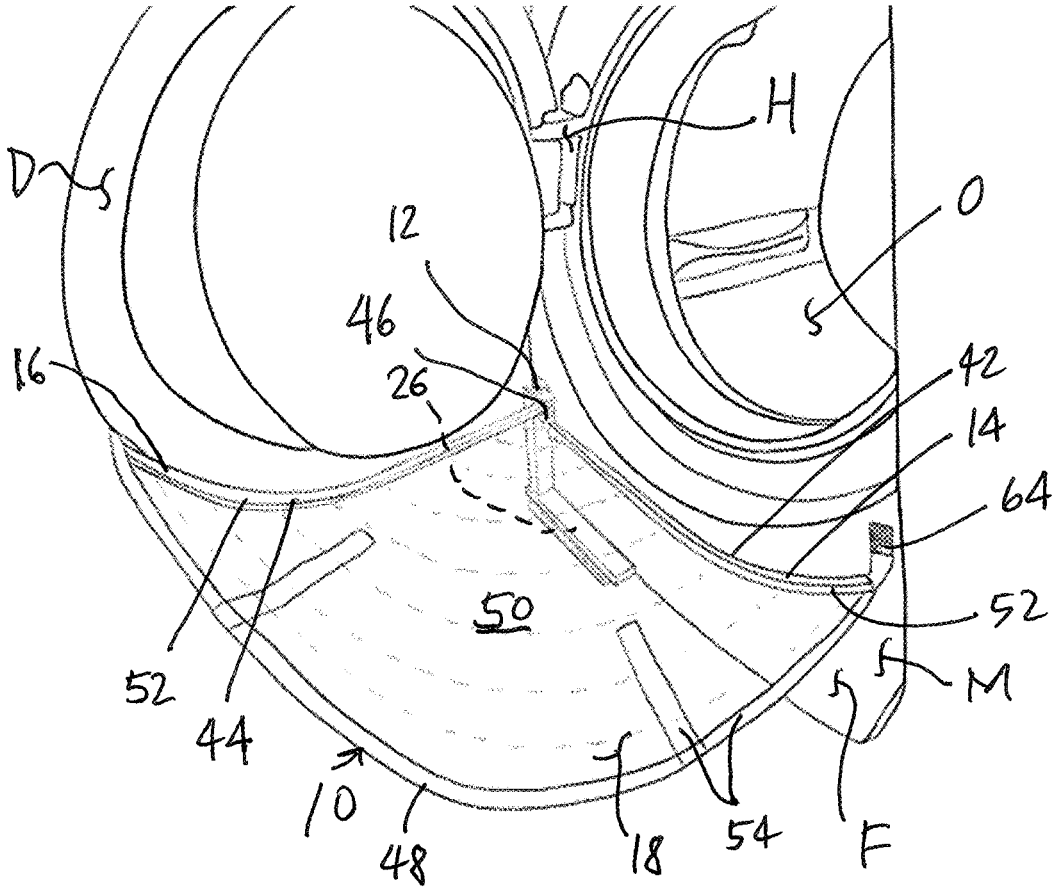
FIGS. 1-25 show an apparatus in accordance with the subject invention, including various aspects thereof.

With reference to the Figures, an apparatus 10 is shown for catching clothes which inadvertently fall during removal from a front loading washing machine or dryer M. The apparatus 10 generally includes a base support 12, a first arm 14, a second arm 16, and a net 18.

Figure 13:
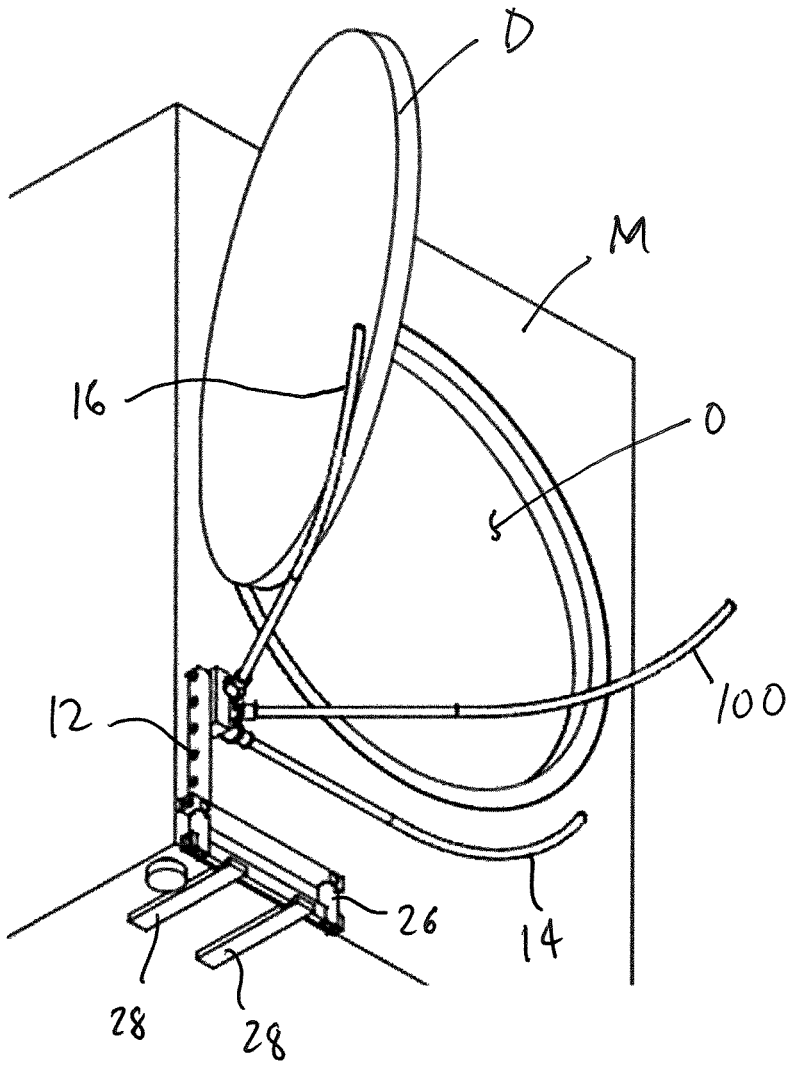
Figure 14:
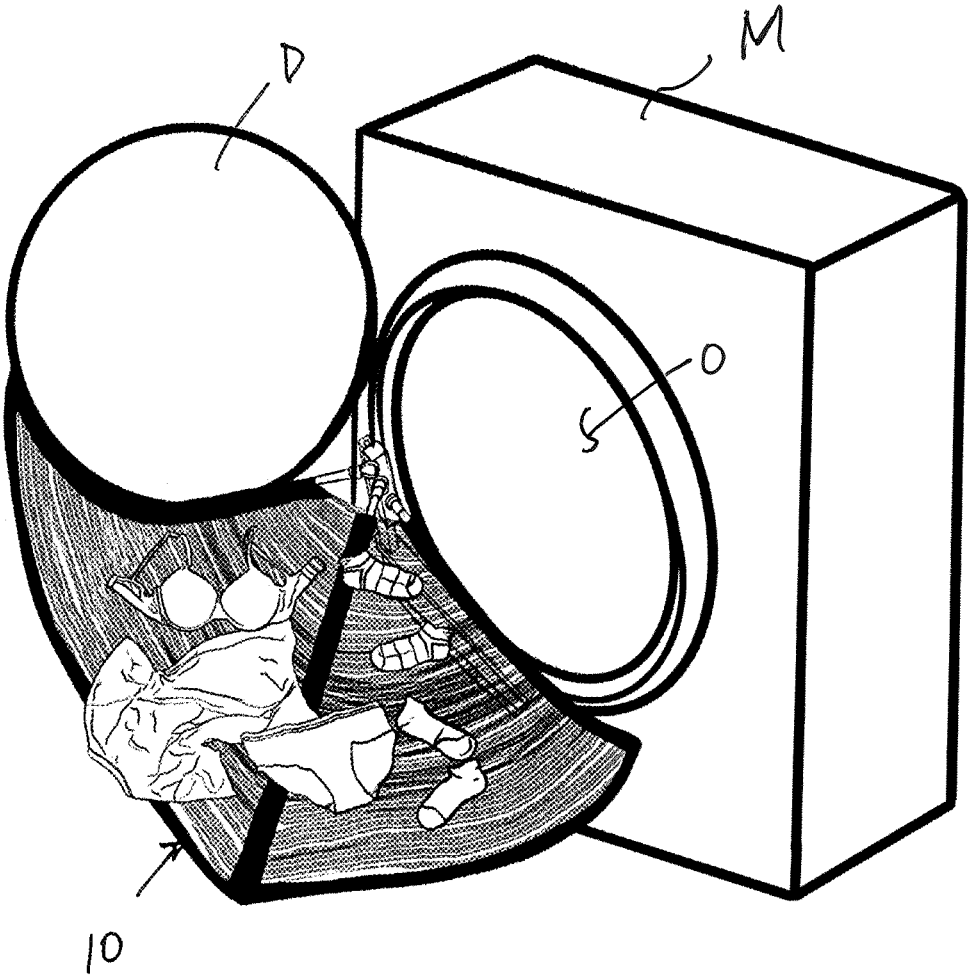
Figure 15:
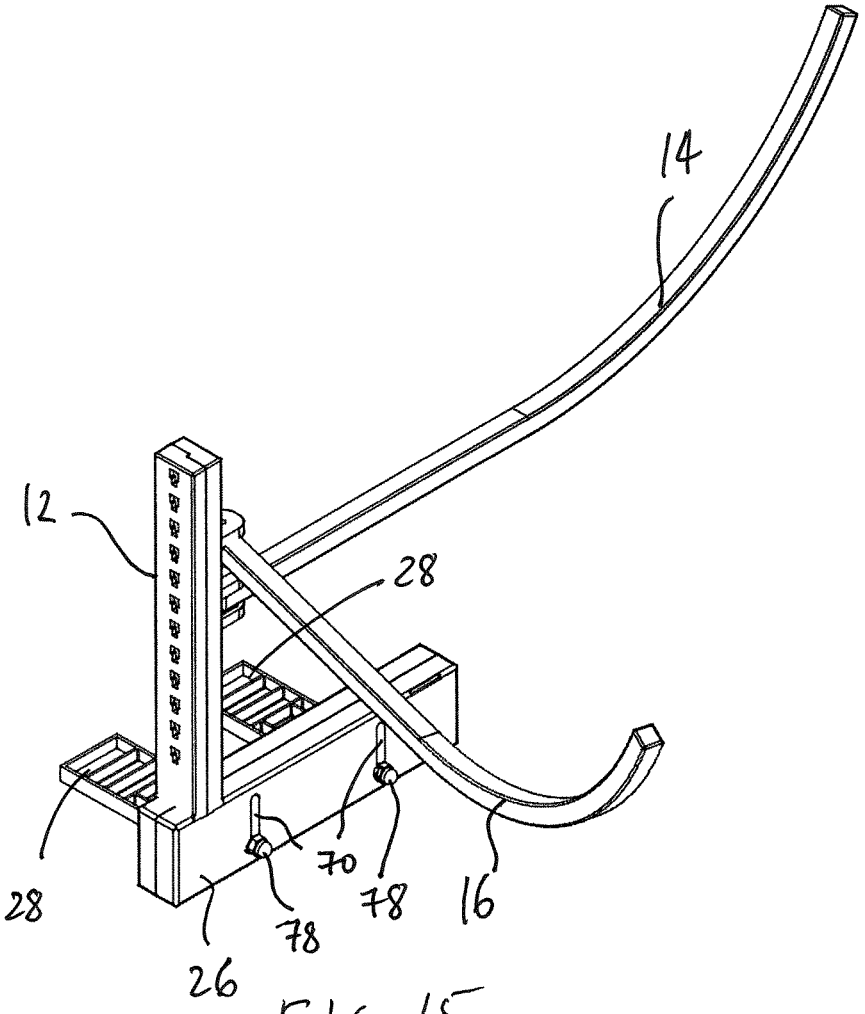
Figure 16:
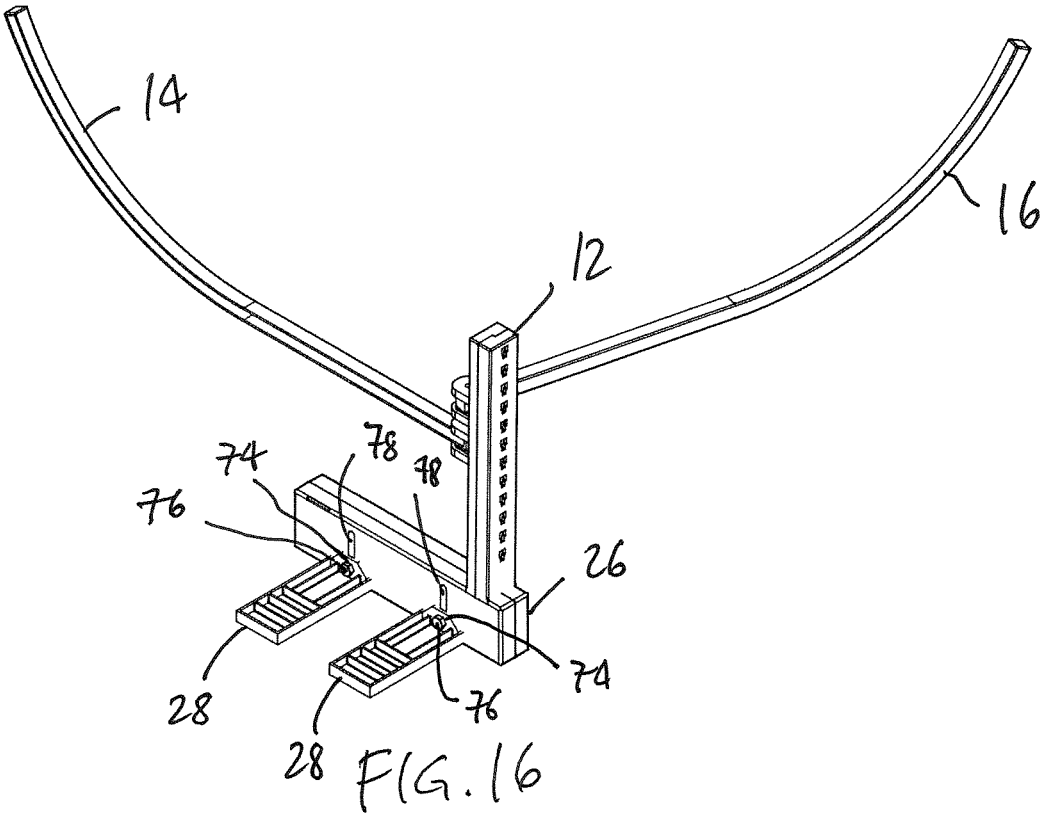
Figure 17:
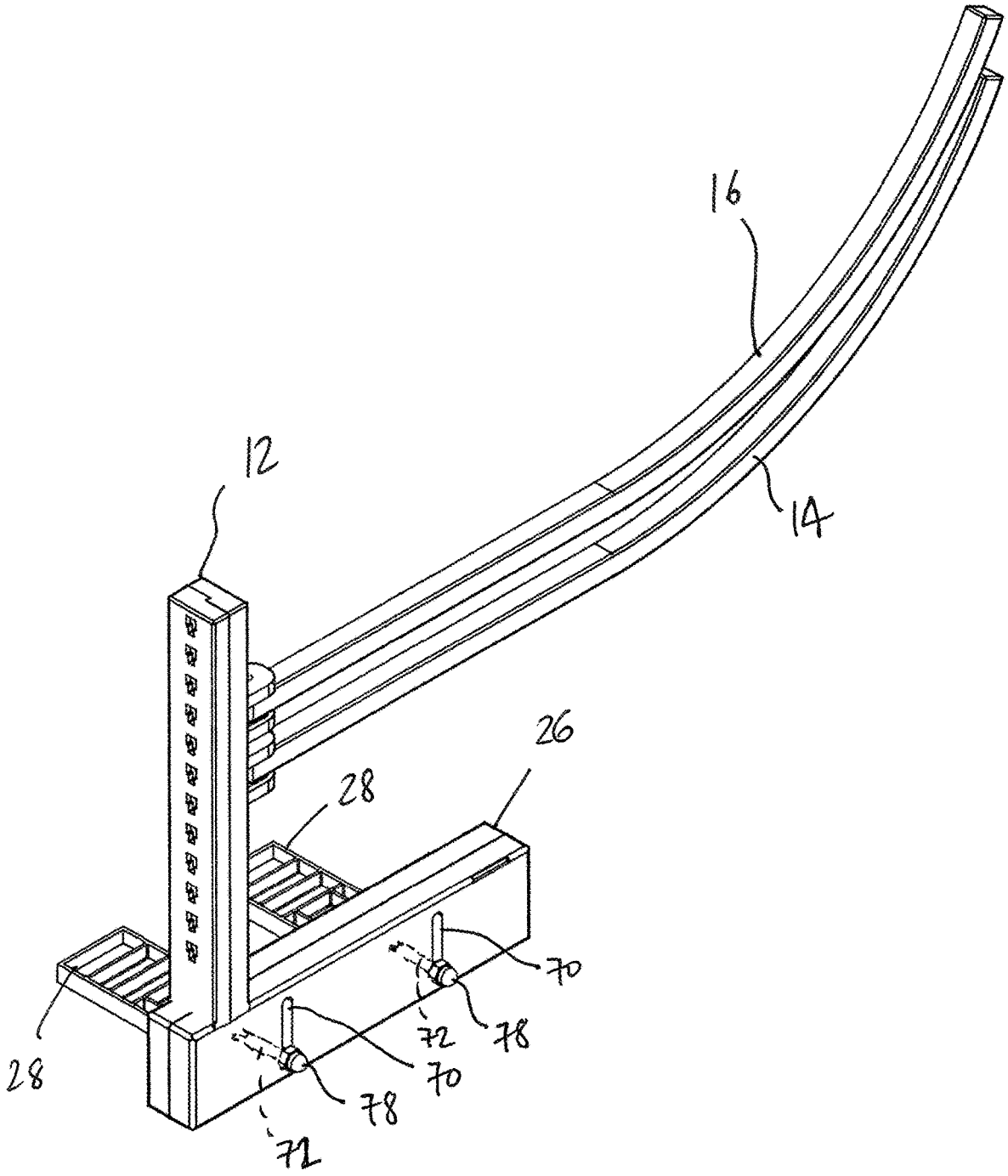
Figure 18:
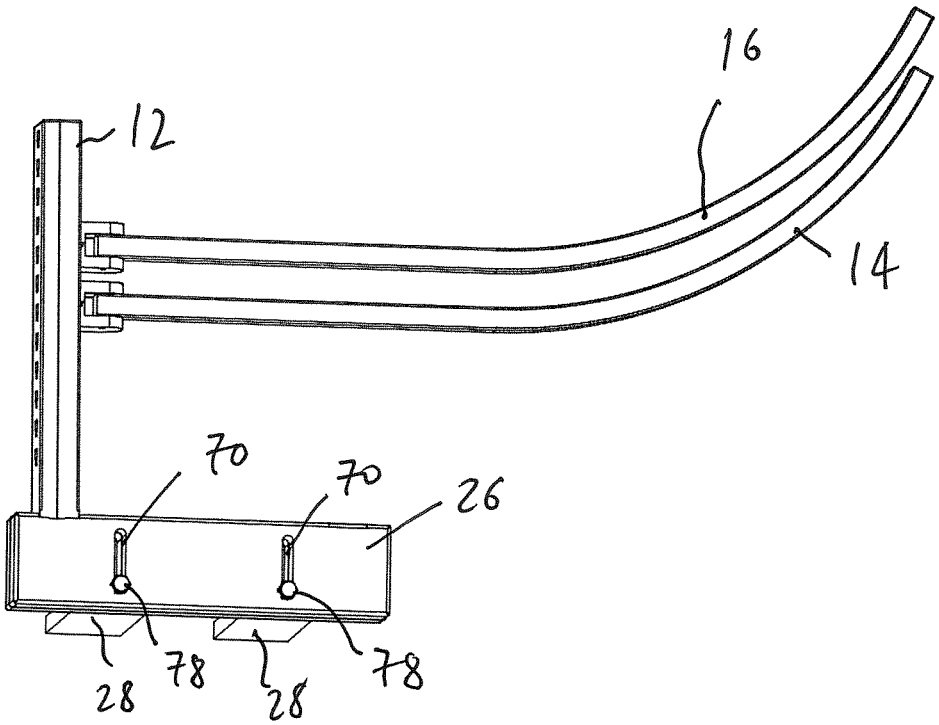
Figure 19:
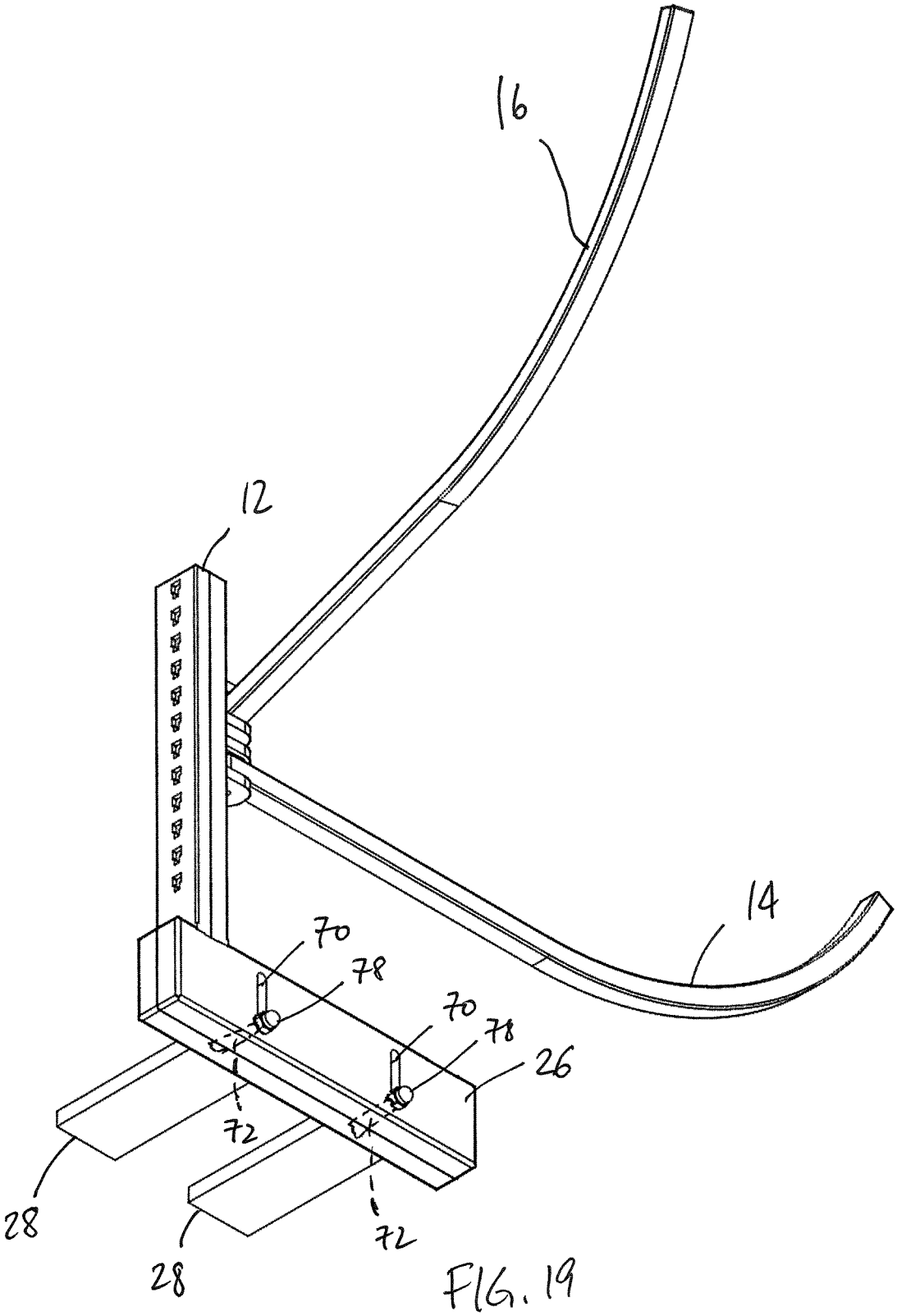
Figure 21:
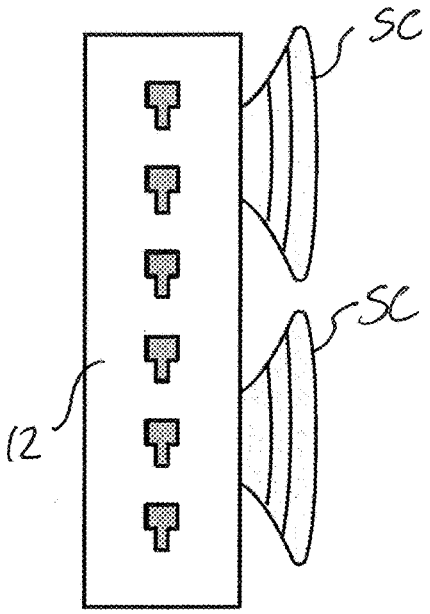

The base support 12 is affixable to the front face F of the front loading washing machine or dryer M so as to be in a fixed position relative to the front loading washing machine or dryer M. As will be appreciated by those skilled in the art, the base support 12 may be affixed relative to the front face F using any manner or technique, including, but not limited to, utilizing one or more magnets, taping, suction cups, adhesion, hook and pile fasteners, fasteners, and combinations thereof. By way of non-limiting example, FIG. 21 shows the base support 12 provided with a plurality of suction cups SC. In addition, or alternatively, a secondary body 26 may be provided extending from the base support 12, the secondary body 26 having one or more outwardly protruding tongues 28 arranged for placement under the front loading washing machine or dryer M (FIG. 13). The weight of the front loading washing machine or dryer M, applied to the underlying one or more tongues 28, provides a holding force for maintaining the secondary body 26, and, thus, the base support 12, in a fixed position relative to the front face F of the front loading washing machine or dryer M.

Figure 25:
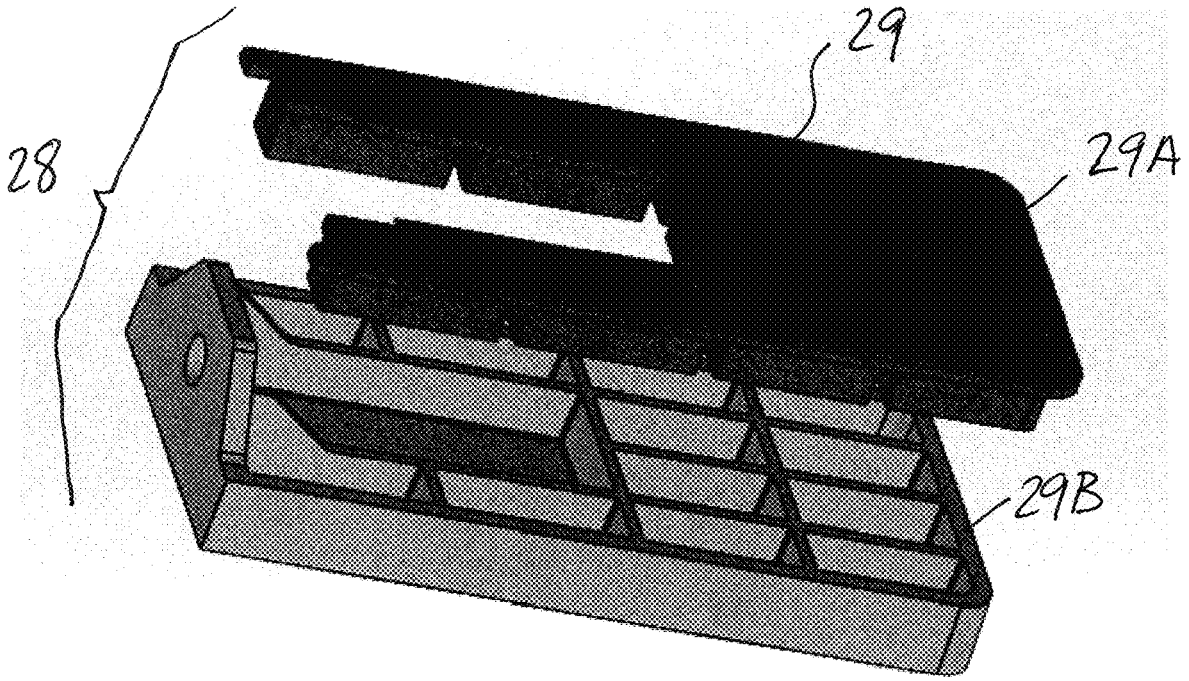

Preferably, the base support 12 is elongated. The secondary body 26 is also preferably elongated and oriented to be generally parallel to a bottom edge of the front loading washing machine or dryer M. It is further preferred that a plurality of the tongues 28 be provided to be spaced-apart along the length of the secondary body 26. This allows for multiple points of contact between the secondary body 26 and the front loading washing machine or dryer M with the weight thereof being distributed along the length of the secondary body 26. Upper surfaces 29 of one or more of the tongues 28 may be frictionally enhanced to minimize relative movement between the front loading washing machine or dryer M and the secondary body 26. For example, the upper surfaces 29 may be textured and/or treated to be frictionally enhanced. As shown in FIG. 25, one or more of the tongues 28 may be formed modular with the upper surfaces 29 being formed on an upper portion 29A which is securable to a lower portion 29B. With a modular arrangement, the upper and lower portions 29A, 29B may be formed of different materials. For example, the upper portion 29A may be formed with silicone defining the upper surface 29 with the lower portion 29B being formed of a plastic and/or metal material.

Figure 2:
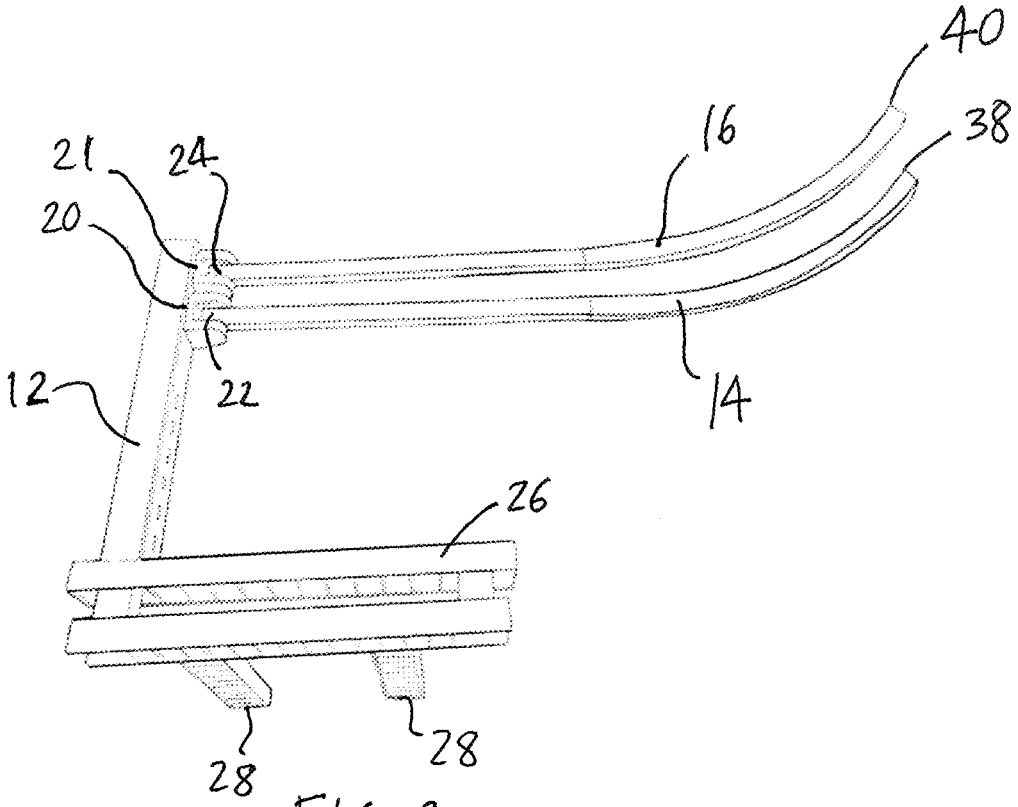
Figure 3:
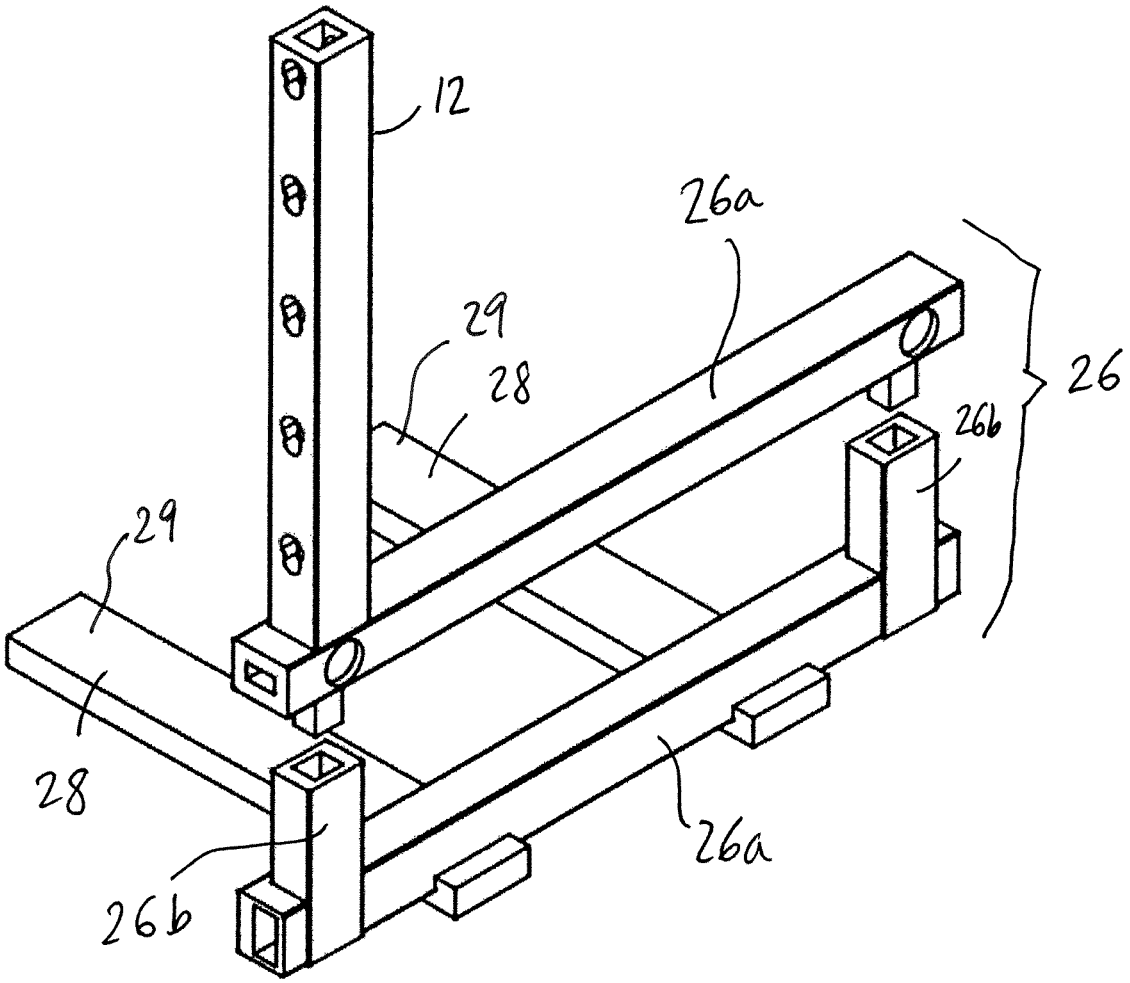

In addition, the secondary body 26 may be transversely oriented (e.g. generally perpendicularly) to the base support 12. This allows for the base support 12 to be located to one side of the front face F with the secondary body 26 having length to extend across the front face F as well (e.g., for weight distribution as described above). The base support 12 is preferably located on the front face F on the same side of the access opening O as where hinged door D is hingedly connected to the front loading washing machine or dryer M. For example, as shown in FIG. 1, the base support 12 is located to the left of the access opening O along with hinge H of the hinged door D. The secondary body 26 may be frame-shaped, as shown in FIGS. 2 and 3, having parallel longitudinal members 26*a*, fixed to transversely-disposed end members 26*b*. The secondary body 26 may be rigidly secured to the base support 12, including being formed wholly or partially unitarily therewith, or being modularly formed therewith. Alternatively, the secondary body 26 may be formed to be position-adjustable along the length of the base support 12 to allow relative adjustment between the parts. A locking arrangement may be also provided to secure the secondary body 26 in a desired location relative to the base support 12.

With further reference to FIGS. 15-19, the tongues 28 may be formed to be vertically adjustable relative to the secondary body 26. Any form of connection allowing vertical adjustment may be utilized between the secondary body 26 and the tongues 28. By way of non-limiting example, a slot 70 (e.g., vertically aligned slot) may be formed through the secondary body 26 corresponding to each of the tongues 28. An elongated fixation member 72 is provided for each of the tongues 28 which extends through a fixation opening 74 formed in the respective tongue 28 and the corresponding slot 70. An enlarged head 76 is provided at one end of each of the fixation members 72 with the other end of the fixation member 72 being for engagement with a locking member 78. For example, the fixation member 72 may be threaded with the locking member 78 being a threaded nut. Alternatively, the fixation member 72 and the locking member 78 may be configured to engage in a bayonet-lock configuration. Further, the locking member 78 may be an axle cap or other friction-fit element suitable to be friction fit onto the end of the fixation member 72. In use, the fixation member 72 extends through the fixation opening 74 and the slot 70 (in either direction) with the enlarged head 76 being sized to not pass therethrough. The fixation member 72 is provided to extend beyond from the fixation opening 74 or the slot 70, depending on direction of entry, with sufficient length to be engaged by the locking member 78. With engagement by the locking member 78, the fixation member 72 should be drawn through the fixation opening 74 and the slot 70 to have the enlarged head 76 press against the secondary body 26 to provide holding force to maintain the corresponding tongue 28 in a desired position along the respective slot 70. Preferably, both the enlarged head 76 and the locking member 78 create pressure on opposing sides of the secondary body 26. The pressure may be directly applied or indirectly applied, with intervening elements being provided between the enlarged head 76 and the secondary body 26 and/or between the locking member 78 and the secondary body 26, such as flat washer(s), split washer(s), lock washer(s), felt, and so forth.

The mode of affixing the base support 12 to the front face F may be chosen to allow for easy temporary use and removed, e.g., at a laundromat, dormitory or apartment laundry facility, and the like. The base support 12 may be used with the secondary body 26 in a more permanent setting, where removal of the apparatus is not needed, for example, in a home setting.

A first end 22 of the first arm 14 is mounted to the base support 12 at connection 20. The first arm 14 is intended to be affixed to the front face F of the washing machine or dryer M during use. In other words, during use, the first arm 14 does not need to move or pivot. Thus, the first arm 14 may be rigidly mounted to the base support 12. Optionally, e.g., to facilitate compact storage, the first arm 14 may be pivotably mounted to the base support 12 so that the first arm 14 is rotatable relative thereto. In addition, a first end 24 of the second arm 16 is mounted to the base support 12 at second connection 21. The second arm 16 must be rotatable about the base support 12 during use. Thus, the first end 24 of the second arm 16 is pivotably mounted to the base support 12. Preferably, the connection 20 of the first arm 14 is located below the connection 21 of the second arm 16 along the base support 12.

Figure 6A:
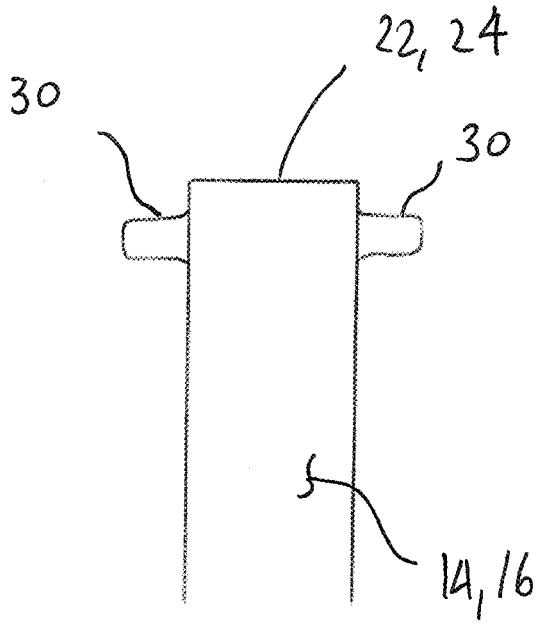
Figure 6B:
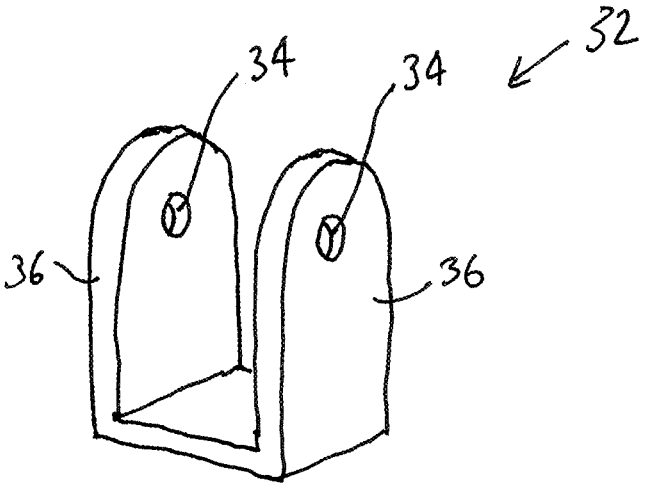
Figure 7:
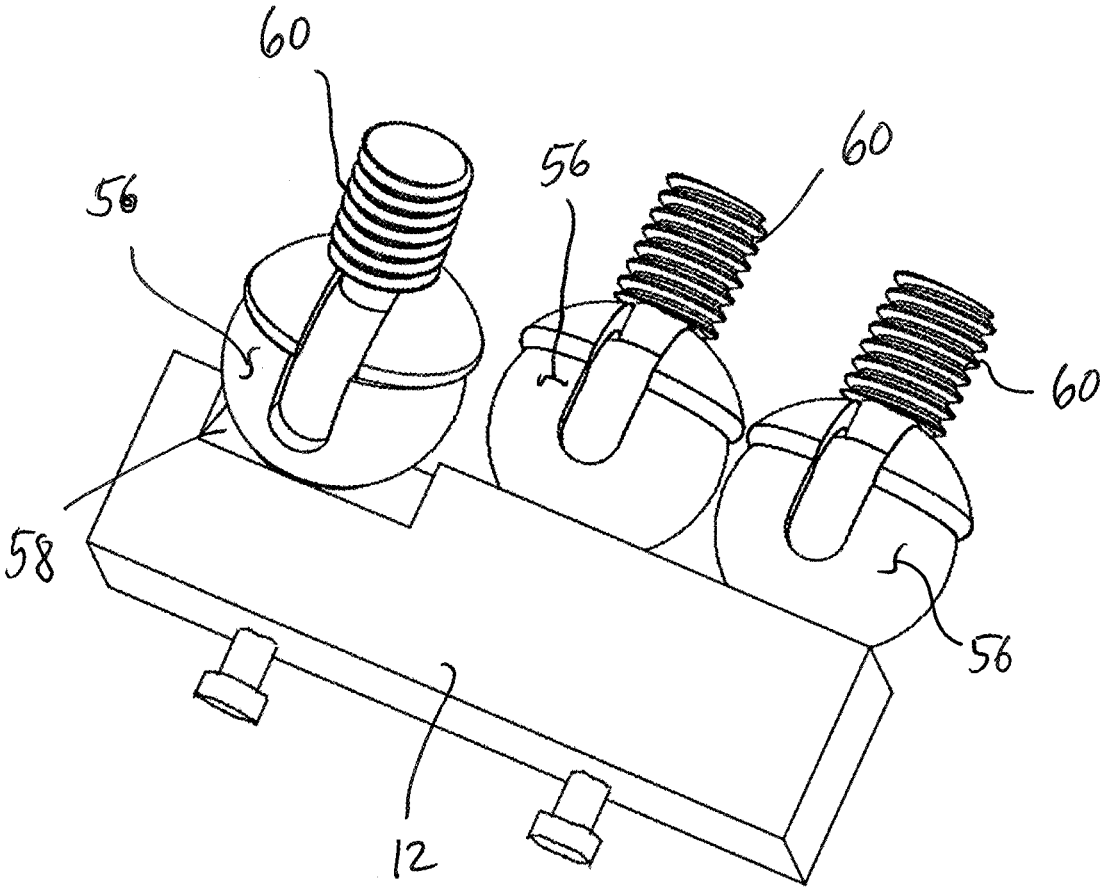
Figure 8:
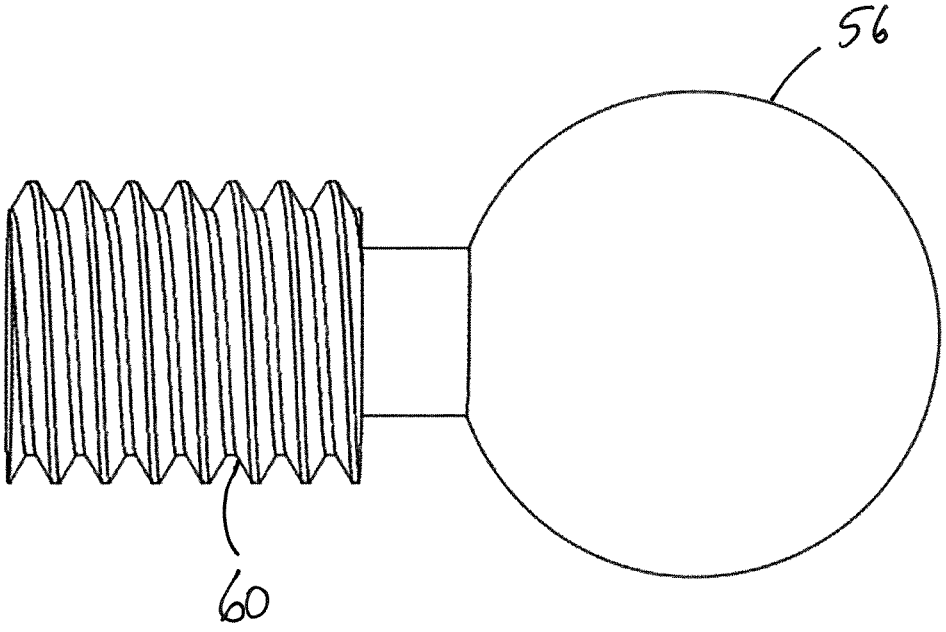
Figure 9:
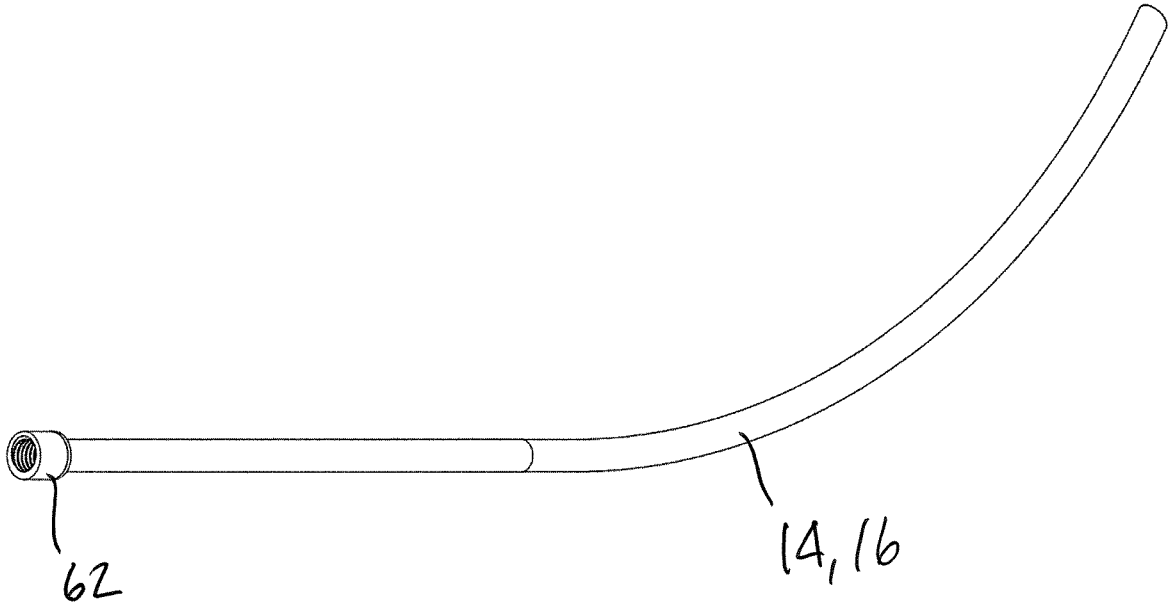

As will be appreciated by those skilled in the art, any pivotable mounting arrangement may be utilized in connection with the base support 12. By way of non-limiting example, as shown in FIGS. 4-6B, one or more pivot pins 30 may be provided on the respective first arm 14 or second arm 16, particularly adjacent to the respective first end 22/first end 24. Corresponding U-shaped brackets 32 are provided on the base support 12, each having at least one mounting hole 34 formed therein formed to receive one of the pivot pins 30. Preferably, a pair of pivot pins 30 are provided on the respective arm 14, 16 to extend in opposing directions, but aligned along a common axis. Correspondingly, each of the brackets 32 includes a mounting hole 34 in each sidewall 36 also aligned along a common axis. The mounting holes 34 may be through-holes, as shown in FIG. 6B, or be of limited depth and not pass through the respective sidewall 36 (i.e., be blind). This allows for the pivot pins 30 to be received in both sidewalls 36 of a bracket 32 along a common axis which defines an axis of rotation about which the respective arm rotates. As appreciated by those skilled in the art, the locations of the pivot pins 30 and the mounting holes 34 may be interchanged in various combinations between being located on the first arm 14/second arm 16 and the base support 12. In addition, other pivotable mounting arrangements are useable, including ball joint connections, as shown in FIGS. 7-9. Here, a spherical member 56 may be provided which is captured in a pocket 58. This arrangement allows the spherical member 56 to rotate within the pocket 58 without separation therefrom. In FIG. 7, pocket 58 is shown formed on the base support 12 which receives spherical member 56 intended for mounting to the respective first arm 14 or second arm 16. The spherical member 58 includes threaded stem 60 which is threadedly received within internally threaded fitting 62 provided on the respective first arm 14 or second arm 16. Similar pivotable connections may be formed. With the first arm 14 and the second arm 16 being pivotably mounted to the base support 12, the axis of rotation of both pivotable connections may be generally coaxially aligned.

Figure 4:
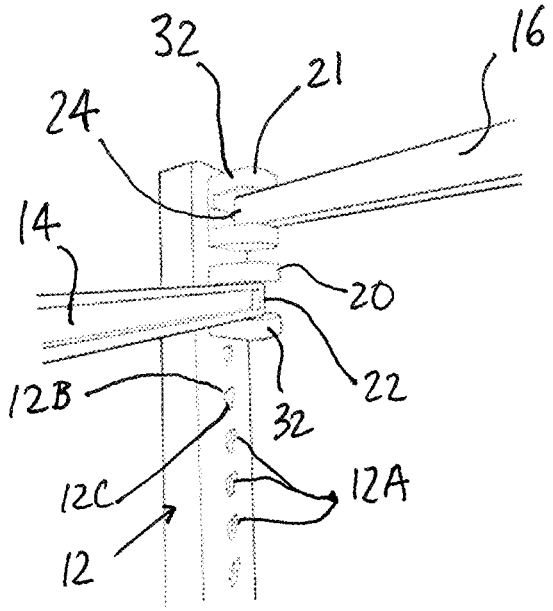
Figure 4A:
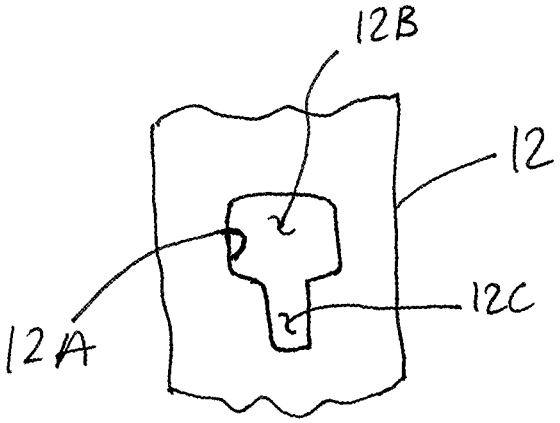
Figure 5:
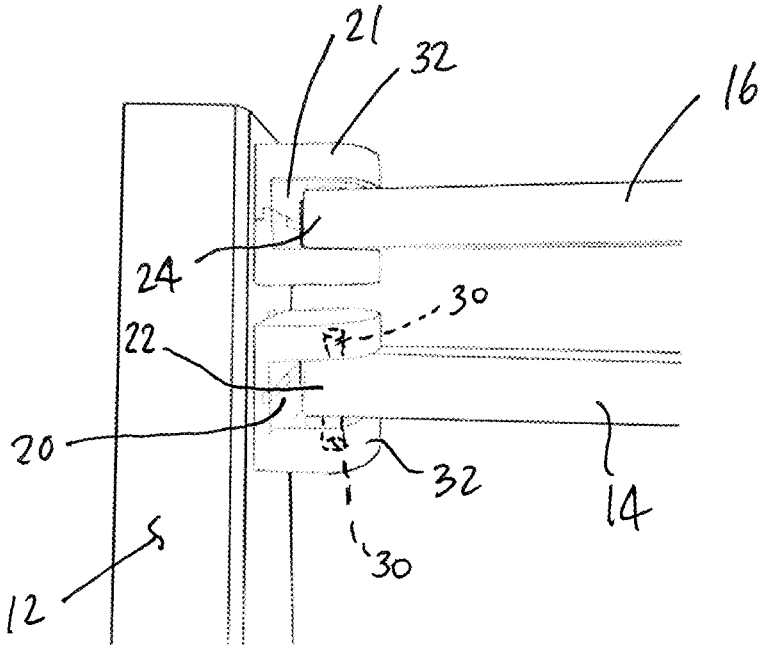
Figure 22:
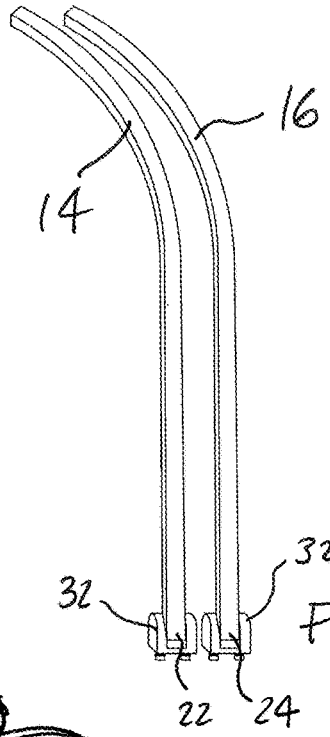
Figure 23:
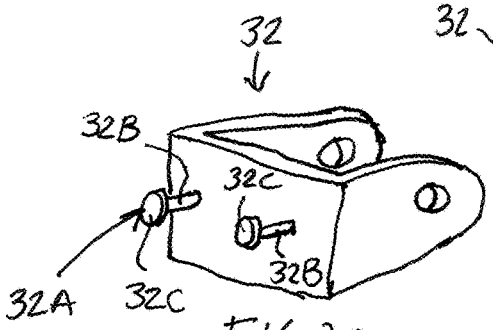

Alternatively, as shown in FIG. 22, the brackets 32 may be pre-mounted to the first and/or second arm 14, 16 particularly at the first ends 22, 24, thereof. With this arrangement, the first or second arm 14, 16 is mounted with the respective bracket 32 being mounted to the base support 12. Any mounting arrangement may be used, preferably which allows for removal and replacement. By way of non-limiting example, as shown in FIG. 23, each of the brackets 32 may be provided with one or more protruding mounting pins 32A with each having a shank 32B with an enlarged head 32C at the end thereof. As shown in FIGS. 4 and 4A, the base support 12 may include a plurality of mounting apertures 12A, each having an enlarged upper portion 12B with a downward extending narrower portion 12C. The upper portion 12B is sized to permit passage therethrough of an enlarged head 32C of a mounting pin 32A with the narrower portion 12C being sized to prevent passage therethrough of the enlarged head 32C. The narrower portion 12C is sized to permit passage therethrough of the shank 32B. With this arrangement, to mount a bracket 32 to the base support 12, the enlarged head 32C is caused to pass through the upper portion 12B of a mounting aperture 12A, after which the bracket 32 is urged downwardly to seat the shank 32B in the narrower portion 12C. This arrangement prevents the enlarged head 32C from passing through the respective mounting aperture 12A once mounted in maintaining the bracket 32 mounted thereto. The process may be reversed to remove the bracket 32. With the bracket 32 having more than one mounting pin 32A, the mounting pins 32A may be caused to simultaneously mount to a corresponding quantity of mounting apertures 12A. The mounting apertures 12A are preferably arranged along the base support 12 to allow for simultaneous accommodation of a plurality of the mounting pins 32A of a bracket 32.

A plurality of the mounting aperture 12A along the base support 12 allows for various mounting positions for the first and second arms 14, 16. This allows for different mounting positions for the first and second arms 14, 16 along a vertical axis of the front face F of the washing machine or dryer M. The first and second arms 14, 16 may, thus, be positioned to be clear of the access opening O and to properly engage the hinged door D.

The base support 12 is affixed to the front face F of the washing machine or dryer M to be at least partially below access opening O. It is preferred that the connection 20 and the second connection 21 be located below the access opening O, thereby allowing for at least the rotation of the second arm 16 below the access opening O resulting in expansion and contraction of the net 18 below the opening O. The first arm 14 and the second arm 16 should be each provided with a length sufficient to extend from the connections 20, 21, respectively, to beyond the bottom of the access opening O. This length ensures that the first arm 14 and the second arm 16 extend across, and below, the bottom of the access opening O. Each of the first arm 14 and the second arm 16 may be at least partially curved in shape to provide a downwardly curved contour to the net 18 when extended for use. This allows the net 18 to define a pocket for trapping clothes which may inadvertently fall from the access opening O when removing laundry. As shown in FIG. 2, the first arm 14 may be curved along a length extending from second end 38. In addition, the second arm 16 may be curved along a length extending from second end 40. This upward curvature defines an upwardly extending boundary for the net 18 in an extended state which restricts clothes from falling out of the extended net 18.

The net 18 is preferably formed of mesh material and is imparted with some resiliency. The mesh material may be of natural fibers and/or synthetic fibers. As shown in FIG. 1, in an open, use state, the net 18 has a V-shape having first and second edges 42, 44 which extend from vertex 46. An outer edge 48 extends between the first and second edges 42, 44 to bound interior area 50. The interior area 50 is for catching fallen clothing. The net 18 is to be of sufficient integrity to support wet clothing. Banding or other reinforcement 54 may be applied to the outer edge 48 and at other locations along the net 18 to provide reinforcement.

The first and second edges 42, 44 are secured to the first and second arms 14, 16, respectively. Preferably, the first and second edges 42, 44 are secured along the respective lengths thereof to minimize any discontinuities or openings through which laundry may fall through. Preferably, a mounting sleeve 52 is provided along each of the first and second edges 42, 44 defining an elongated channel for receiving the first arm 14 and the second arm 16, respectively. The mounting sleeves 52 may be each formed by the mesh material of the net 18 and/or by a strip of different material attached to the net 18.

Figure 20:
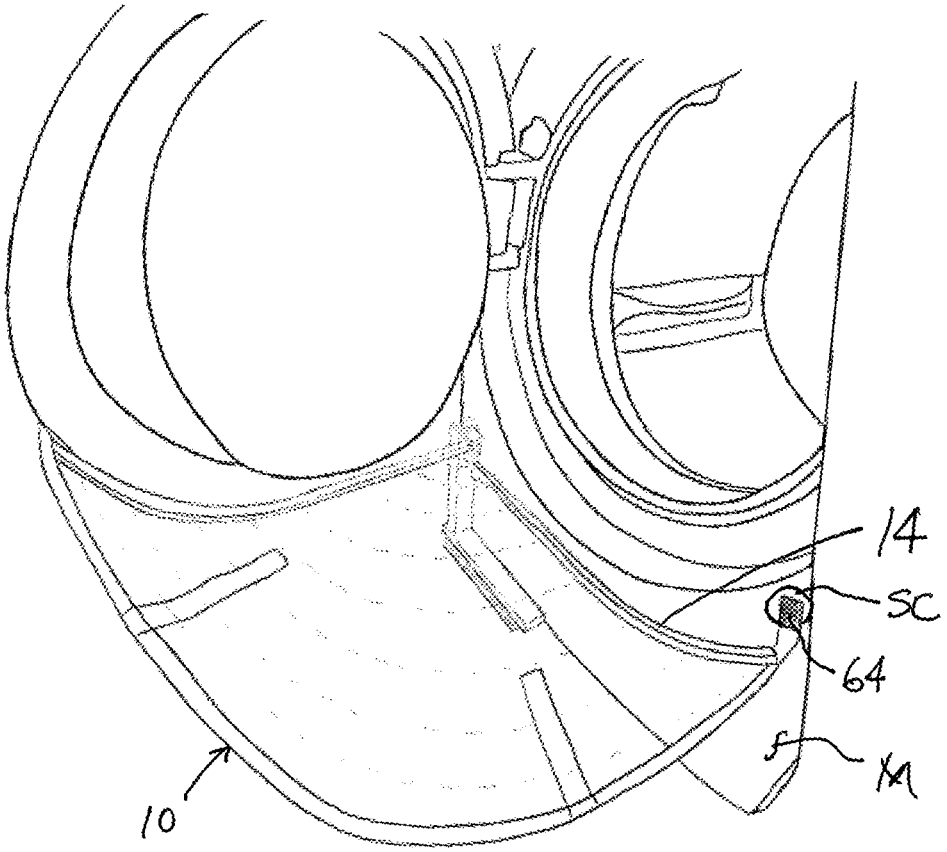

The first arm 14 is affixed to the front face F of the washing machine or dryer M for use. The first arm 14 may be affixed by one or more of: affixing a portion of the first arm 14 directly to the front face F of the front loading washing machine or dryer M; and, affixing a portion of the net 18 to the front face of the front loading washing machine or dryer. The first arm 14 may be affixed using any manner or technique, including, but not limited to, utilizing one or more magnets, suction cups, taping, adhesion, hook and pile fasteners, fasteners, and combinations thereof. By way of non-limiting example, as shown in FIG. 1, a tab 64 may extend from the first edge 42 of the net 18 which is affixable to the front face F of the front loading washing machine or dryer M. The tab 64 may be provided with any of the aforementioned modes of affixing, including being provided with a suction cup SC (FIG. 20).

The second end 40 of the second arm 16 is affixed to hinged door D of the front loading washing machine or dryer M. In particular, the second end 40 is affixed to the hinged door D at a location spaced from, and not coincident with, a hinge axis about which the hinged door D rotates. This ensures that the second end 40 will move with the hinged door D with rotation thereof. It is additionally noted that it is critical that the hinged door D be properly closeable to seal the access opening O with the front loading machine or dryer M in use. Thus, the second arm 16 should not impede such closure. The second end 40 preferably is affixed to an external location of the hinged door D. The second arm 16 should be out of contact with the side edge and inner portions of the hinged door D with the hinged door D being rotated to a closed position.

Figure 10:
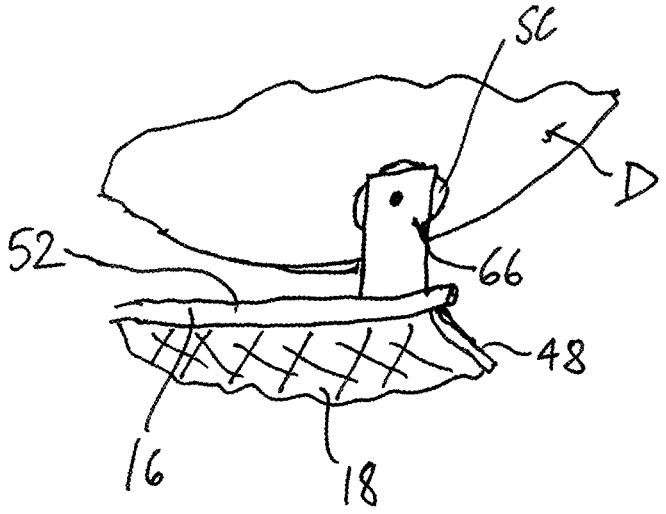
Figure 11:
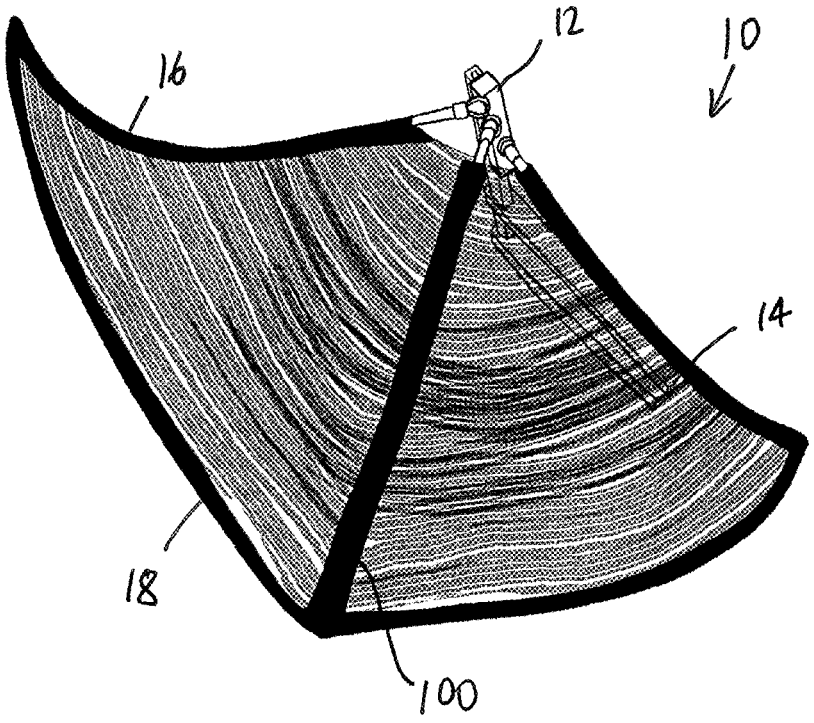
Figure 12:
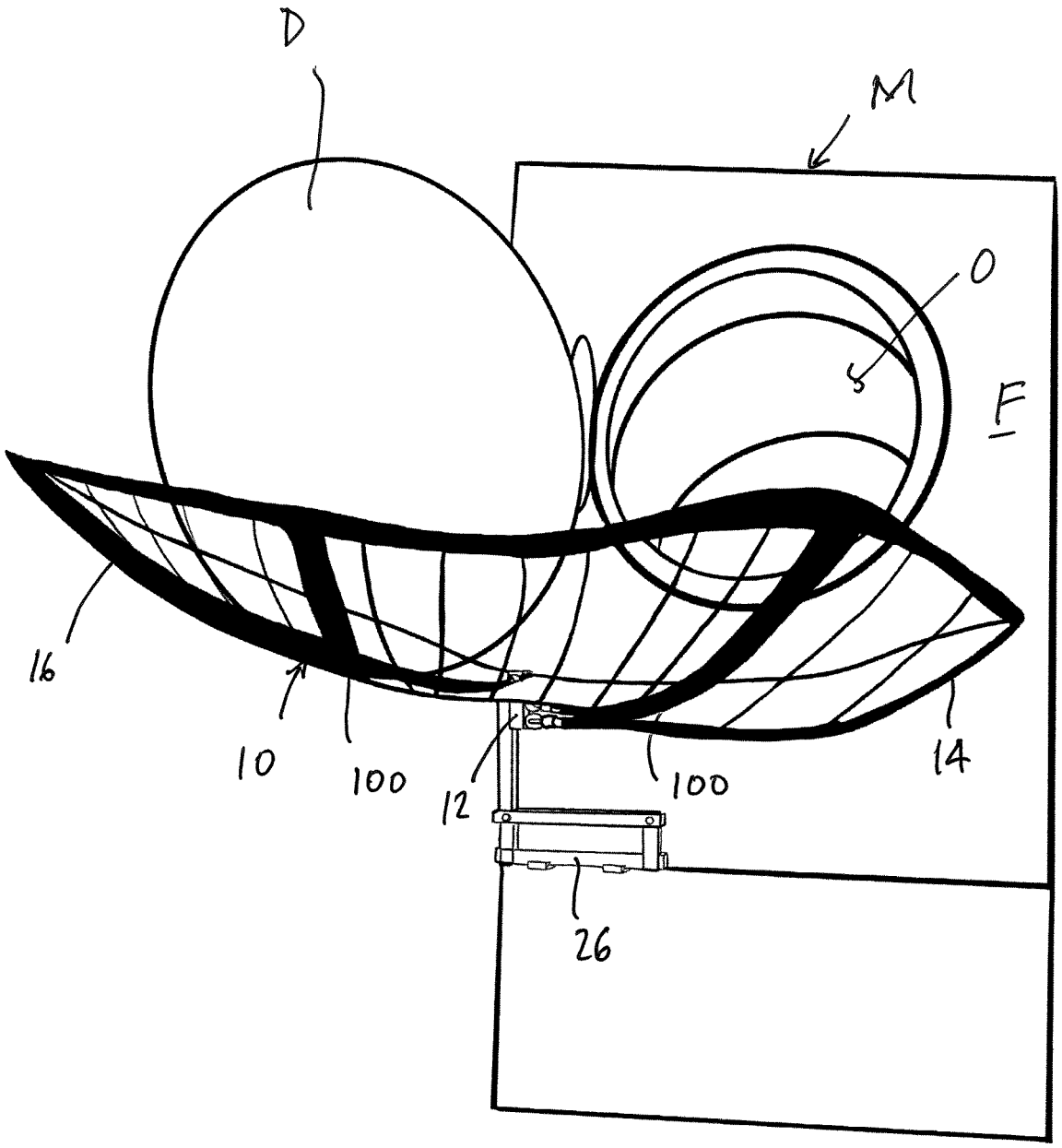

The second arm 16 may be affixed by one or more of: affixing a portion of the second arm 16 directly to the hinged door D; and, affixing a portion of the net 18 to the hinged door D. The second arm 16 may be affixed using any manner or technique, including, but not limited to, utilizing one or more magnets, suction cups, taping, adhesion, hook and pile fasteners, fasteners, and combinations thereof. By way of non-limiting example, as shown in FIG. 10, a tab 66 may extend from the second edge 44 of the net 18 which is affixable to the hinged door D. The tab 66 may be provided with any of the aforementioned modes of affixing, including being provided with a suction cup SC (FIG. 10).

Figure 24:
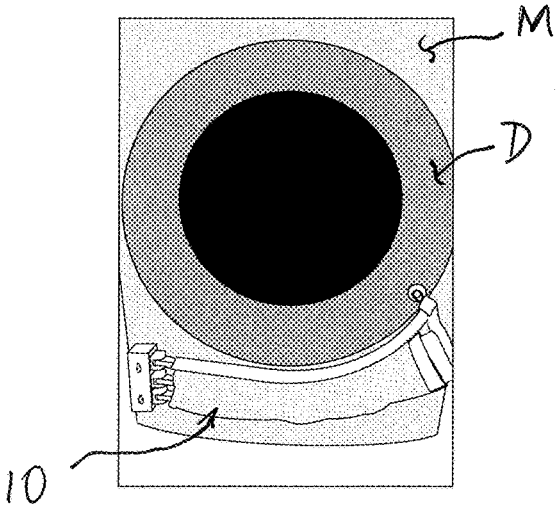

With the second arm 16 being affixed to the hinged door D, the second arm 16 moves with rotation of the hinged door D between a closed position (covering the access opening O (FIG. 24)), in which the second arm 16 is in proximity to the first arm 14 with the net 18 being in a folded condition, and an open position (the access opening O being exposed and not covered (FIG. 1)), in which the second arm 16 is spaced from the first arm 14 with the net 18 being in an extended condition. It is expected that the hinged door D shall be rotatable by at least 90 degrees from the closed state to an open state. Accordingly, in the open state, the second end 38 of the first arm 14 and the second end 40 of the second arm 16 may subtend 90 or more degrees therebetween.

As will be appreciated by those skilled in the art, the first arm 14, the second arm 16, and the net 18 may be provided in different sizes to accommodate different sized front loading washing machines or dryers.

As shown in FIGS. 11-14, one or more additional arm(s) 100 may be provided to add additional support to the net 18, particularly in the open state. The additional arm(s) 100 may be formed and pivotably mounted to the base support 12 in the same manner as described above in connection with the first and second arms 14, 16. The additional arm(s) 100 would be located between the first and second arms 14, 16 with the mesh 18 in the open state. Mounting sleeve(s) 52 may be provided for each of the additional arm(s). The additional arm(s) 100 will pivotably move, along with the second arm 16, with the opening and closing of the hinged door D.

Significantly, the apparatus 10 may be provided as a unitary structure which may be easily implemented for use and removed between uses. The apparatus 10 includes the base support 12, with the first and second arms 14, 16 (and optionally one or more additional arm(s) 100) having the net 18 secured thereto. The apparatus 10 may be implemented by affixing the base support 12 and each of the first and second arms 14, 16, as described above, for example, with the hinged door D being in a closed state. Upon opening the hinged door D, the net 18 is expanded to define a catch area for clothing being removed from the front loading washing machine or dryer M. It is noted that the apparatus 10 can be moved between washing machine and dryer during a laundry cycle to be used in connection with both machines if located side-by-side. Moreover, upon completion of the laundry cycle, the base support 12 and the first and second arms 14, 16 may be detached with the first and second arms 14, 16 being urged into alignment (e.g, as shown in FIG. 2) to minimize the size of the apparatus 10. Any additional arm(s) 100 are also urged into alignment with the first and second arms 12, 14. This allows for storage and/or transportation of the apparatus 10 between uses. Conveniently, the apparatus 10 may be easily transported between locations to allow for use (e.g., use at home, away at school, during travel, and so forth). It is noted that FIG. 2 does not show the net 18, which would be included but not removed for storage or transportation. Removal of the apparatus 10 may be facilitated by the mode of affixing, certain modes facilitating easier removal and affixation, such as with use of: suction cups, magnets, and/or, the secondary body 26 having the tongues 28.

It is additionally noted that the first and second arms 14, 16 (along with any additional arm(s) 100) may be removable from/re-attachable to the base support 12 to provide further compaction. The net 18 may be also formed to be removed/re-attached from the arms 14, 16, 100. Further, one or more of the individual arms 14, 16, 100 may be each formed from two or more parts which telescope and/or modular connect to allow further disassembly/re-assembly.

What is claimed is:

1. An apparatus for catching clothes which inadvertently fall during removal from a front loading washing machine or dryer, the front loading washing machine or dryer having an access opening on a front face thereof with a hinged door being pivotable about a hinge axis to selectively cover and expose the access opening, the apparatus comprising:

a base support affixable to the front face of the front loading washing machine or dryer;

a first arm having first and second ends, the first end of the first arm being mounted to the base support, the first arm being affixable to the front face of the front loading washing machine or dryer;

a second arm having first and second ends, the first end of the second arm being pivotably mounted to the base support so that the second arm is pivotable about an axis of rotation, the second end of the second arm being affixable to the hinged door at a location spaced from, and not coincident with, the hinge axis such that the second end of the second arm is movable with the hinged door, wherein the first end of the first arm is mounted to the base support such that the first end of the first arm impinges upon the axis of rotation;

a net secured to the first and second arms so as to extend between the first and second arms with the second arm being in different angular positions about the base support, wherein, when the second end of the second arm is affixed to the hinged door at a location spaced from the hinge axis and when the hinged door covers the access opening, the second end of the second arm is in proximity to the second end of the first arm, and, wherein, when the second end of the second arm is affixed to the hinged door at a location spaced from the hinge axis and when the hinged door is positioned to expose the access opening, the second end of the second arm is spaced from the second end of the first arm with the net extending between the first and second arms below the access opening.

2. The apparatus of claim 1, wherein, when the second end of the second arm is affixed to the hinged door at a location spaced from the hinge axis and when the hinged door is positioned to expose the access opening, the second end of the second arm is spaced from the second end of the first arm such that 90 or more degrees are subtended between the first and second arms.

3. The apparatus of claim 1, wherein the first arm is curved between the first and second ends thereof.

4. The apparatus of claim 3, wherein the second arm is curved between the first and second ends thereof.

5. The apparatus of claim 1 further comprising a third arm having first and second ends, the first end of the third arm being pivotably mounted to the base support so that the third arm is pivotable about the base support, the third arm being affixed to a portion of the net so that, when the second end of the second arm is affixed to the hinged door at a location spaced from the hinge axis and when the hinged door is positioned to expose the access opening, the second end of the third arm is located between, and spaced from, both the second end of the first arm and the second end of the second arm.

6. The apparatus of claim 1, wherein, when in use, the first arm is affixed to the front face of the front loading washing machine or dryer by one or more of: affixing a portion of the first arm directly to the front face of the front loading washing machine or dryer; and affixing a portion of the net to the front face of the front loading washing machine or dryer.

7. The apparatus of claim 1, wherein, when in use, the second end of the second arm is affixed to the hinged door by one or more of: affixing a portion of the second arm directly to the hinged door; and affixing a portion of the net to the hinged door.

8. The apparatus of claim 1, wherein the first end of the first arm is mounted to the base support at a location which is below a location of where the first end of the second arm is pivotably mounted to the base support.

9. The apparatus of claim 1, wherein the base support is configured to be affixed to the front face of the front loading washing machine or dryer by one or more suction cups.

10. The apparatus of claim 1, wherein the base support includes a secondary body with one or more protruding tongues arranged for placement under the front loading washing machine or dryer, wherein, when in use, weight of the front loading washing machine or dryer, applied to the one or more protruding tongues, provides a holding force for affixing the base support to the front face of the front loading machine or dryer.

11. The apparatus of claim 1, wherein the first end of the first arm is pivotably mounted to the base support so that the first arm is pivotable about the axis of rotation.

12. The apparatus of claim 5, wherein the first end of the third arm is pivotably mounted to the base support so that the third arm is pivotable about the axis of rotation.

13. An apparatus for catching clothes which inadvertently fall during removal from a front loading washing machine or dryer, the front loading washing machine or dryer having an access opening on a front face thereof with a hinged door being pivotable about a hinge axis to selectively cover and expose the access opening, the apparatus comprising:

a base support affixable to the front face of the front loading washing machine or dryer;

a first arm having first and second ends, the first end of the first arm being mounted to the base support, the first arm being affixable to the front face of the front loading washing machine or dryer;

a second arm having first and second ends, the first end of the second arm being pivotably mounted to the base support so that the second arm is pivotable about the base support, the second end of the second arm being affixable to the hinged door at a location spaced from, and not coincident with, the hinge axis such that the second end of the second arm is movable with the hinged door;

a third arm having first and second ends, the first end of the third arm being pivotably mounted to the base support so that the third arm is pivotable about the base support;

a net secured to the first and second arms so as to extend between the first and second arms with the second arm being in different angular positions about the base support, wherein, when the second end of the second arm is affixed to the hinged door at a location spaced from the hinge axis and when the hinged door covers the access opening, the second end of the second arm is in proximity to the second end of the first arm, wherein, when the second end of the second arm is affixed to the hinged door at a location spaced from the hinge axis and when the hinged door is positioned to expose the access opening, the second end of the second arm is spaced from the second end of the first arm with the net extending between the first and second arms below the access opening, and wherein, the third arm is affixed to a portion of the net so that, when the second end of the second arm is affixed to the hinged door at a location spaced from the hinge axis and when the hinged door is positioned to expose the access opening, the second end of the third arm is located between, and spaced from, both the second end of the first arm and the second end of the second arm.

14. The apparatus of claim 13, wherein, the first end of the second arm is pivotably mounted to the base support to be pivotable about an axis of rotation, and, wherein the first end of the third arm is pivotably mounted to be base support to be pivotable about the axis of rotation.

15. The apparatus of claim 14, wherein, the first end of the first arm is pivotably mounted to the base support to be pivotable about the axis of rotation.

16. The apparatus of claim 13, wherein, the base support is configured to be affixed to the front face of the front loading washing machine or dryer by one or more suction cups.

17. The apparatus of claim 13, wherein, the base support includes a secondary body with one or more protruding tongues arranged for placement under the front loading washing machine or dryer, wherein, when in use, weight of the front loading washing machine or dryer, applied to the one or more protruding tongues, provides a holding force for affixing the base support to the front face of the front loading machine or dryer.

18. The apparatus of claim 13, wherein, when in use, the first arm is affixed to the front face of the front loading washing machine or dryer by one or more of: affixing a portion of the first arm directly to the front face of the front loading washing machine or dryer; and affixing a portion of the net to the front face of the front loading washing machine or dryer.

19. The apparatus of claim 13, wherein, when in use, the second end of the second arm is affixed to the hinged door by one or more of: affixing a portion of the second arm directly to the hinged door; and affixing a portion of the net to the hinged door.

20. An apparatus for catching clothes which inadvertently fall during removal from a front loading washing machine or dryer, the front loading washing machine or dryer having an access opening on a front face thereof with a hinged door being pivotable about a hinge axis to selectively cover and expose the access opening, the apparatus comprising:

a base support affixable to the front face of the front loading washing machine or dryer, wherein the base support includes a secondary body with one or more protruding tongues arranged for placement under the front loading washing machine or dryer, wherein, when in use, weight of the front loading washing machine or dryer, applied to the one or more protruding tongues, provides a holding force for affixing the base support to the front face of the front loading machine or dryer;

a first arm having first and second ends, the first end of the first arm being mounted to the base support, the first arm being affixable to the front face of the front loading washing machine or dryer;

a second arm having first and second ends, the first end of the second arm being pivotably mounted to the base support so that the second arm is pivotable about the base support, the second end of the second arm being affixable to the hinged door at a location spaced from, and not coincident with, the hinge axis such that the second end of the second arm is movable with the hinged door;

a net secured to the first and second arms so as to extend between the first and second arms with the second arm being in different angular positions about the base support, wherein, when the second end of the second arm is affixed to the hinged door at a location spaced from the hinge axis and when the hinged door covers the access opening, the second end of the second arm is in proximity to the second end of the first arm, and, wherein, when the second end of the second arm is affixed to the hinged door at a location spaced from the hinge axis and when the hinged door is positioned to expose the access opening, the second end of the second arm is spaced from the second end of the first arm with the net extending between the first and second arms below the access opening.

* * * * *